United States Patent [19]

VanDerlin

[11] 3,946,628

[45] Mar. 30, 1976

[54] ROTARY VENEER CLIPPER AND DRIVE THEREFOR

[76] Inventor: Donald H. VanDerlin, 1084 Hagnes Way, North Bend, Oreg. 97459

[22] Filed: June 2, 1975

[21] Appl. No.: 582,917

[52] U.S. Cl. ..... 83/285; 74/88; 83/289; 83/295; 83/334; 83/347

[51] Int. Cl.[2]..... B26D 1/40; B26D 5/12; B27L 5/08

[58] Field of Search ..... 83/285, 289, 346, 347, 83/365, 295, 639, 334; 74/88, 665 B

[56] References Cited

UNITED STATES PATENTS

| | | | |
|---|---|---|---|
| 3,272,080 | 9/1966 | Avery | 74/88 X |
| 3,410,163 | 11/1968 | Taylor | 83/289 |
| 3,550,477 | 12/1970 | Kinnicutt, Jr. | 74/88 X |

*Primary Examiner*—Frank T. Yost
*Attorney, Agent, or Firm*—Klarquist, Sparkman, Campbell, Leigh, Hall & Whinston

[57] ABSTRACT

A rotary veneer clipper has a pair of cutting blades spaced 180° apart on a rotary clipper shaft for cutting cooperation with a roller anvil below and parallel to the clipper shaft and over which sheet material passes. The clipper shaft rotates intermittently on signal to cause one of its blades to clip the sheet. The clipper shaft is driven by a pair of pneumatic drive cylinders mounted one to each of two crank arms connected to a common drive shaft. The cylinders stroke once simultaneously to rotate the drive shaft alternately in opposite directions through 90° upon each successive clip signal. When the drive shaft rotates in one direction, a first gear train transmits power from the drive shaft through a first one-way clutch to the clipper shaft to rotate one of the blades downwardly and through 180° to clip the sheet. When the drive shaft is rotated in the opposite direction, a second gear train transmits power from the drive shaft to the clipper shaft through a second one-way clutch to rotate the other clipper blade through 180° in the direction of sheet travel to clip the sheet. Locking means including a pneumatic locking cylinder limits clipper shaft rotation to exactly 180° upon each stroking of the drive cylinders to accurately index the cutting blades. An optional blade speed control feature is also provided.

15 Claims, 6 Drawing Figures

ROTARY VENEER CLIPPER AND DRIVE THEREFOR

BACKGROUND OF THE INVENTION

1. Field of the Invention

The present invention relates to a rotary clipper for clipping a traveling sheet of thin material into sections and more particularly to a drive for a rotary clipper especially suited for close-interval clipping of wood veneer.

2. Description of the Prior Art

As a sheet of veneer is peeled from a log chucked in a veneer lathe, the traveling sheet is clipped at intervals by a veneer clipper into sections of random or predetermined lengths for convenience in further handling as the sheet proceeds toward the veneer dryer. It is also common practice to remove defects from the traveling sheet by having the clipper clip it twice in rapid succession, once on either side of the defect, to remove a narrow strip containing the defect from the sheet. This is done automatically using a scanning device upstream of the clipper to detect the position and size of a break in the traveling sheet and to transmit corresponding signals to the clipper to trigger its operation twice in succession at the appropriate time and interval to remove the defective strip from the sheet.

In the interest of minimizing material waste, it is desirable in removing defects to make the clipping interval as close as possible so that only a narrow strip just wide enough to contain the defect is removed. However, to remove a narrow strip from the traveling sheet requires either extremely accurate, high-speed, close-interval clipping or slow-speed sheet travel, or a compromise between the two. Existing clippers are not capable of close-interval clipping at high sheet speeds. As a result, existing veneer clippers are a bottleneck in the veneer manufacturing process.

A problem in clipping veneer that limits clipping and sheet speeds is the tendency of veneer to curl at its clipped ends, particularly veneer peeled from near the core of a log. The curled end edges tend to hang up on the clipper blade, causing bunching, jamming and breakage of the fragile veneer at the blade. When this occurs, the production line must be shut down and the jam and broken material cleared, resulting in a loss of valuable production time and material.

Veneer clippers in common use are of the reciprocative guillotine type in which a single blade is driven vertically downwardly through a traveling sheet and then retracted to clip the sheet into sections. Since the reciprocatory movement of the guillotine blade in this type of clipper is inherently slow and is not in the direction of travel of the sheet, the tendency of the sheet to bunch, jam and break at the blade is particularly great, requiring slow sheet travels speeds not exceeding about 180 feet per minute. Even at such slow speeds, clippers of this type cannot clip out a defective strip less than about 3½ inches wide.

A rotary-type veneer clipper has been proposed, as shown in U.S. Pat. No. 3,808,925, issued May 7, 1974. However, no rotary clippers are known to be in commercial use. The proposed such clipper is characterized by a single thin blade sharpened at both opposite edges to provide two 180° spaced-apart cutting edges, one of which rotates into cutting cooperation with a roller anvil to clip a sheet of veneer moving across the anvil upon each 180° rotation of the blade about its central axis. Since the blade cutting edge moves as it clips in the same direction as the sheet, the problems of bunching, jamming and sheet breakage should be reduced.

However, a rotary clipper has another problem which arises from the inertia of rotary knife movement and the necessity of stopping knife rotation after each clipping stroke to await the next clip signal. To meet this inertia problem, the two-edge blade of the aforementioned proposed rotary clipper is made of very thin lightweight material which requires use of a longitudinally pretensioned blade and a bracing roll which is engaged by one of the two cutting edges to prevent blade deflection as the other cutting edge contacts the roller anvil to make the cut. Thus in such a rotary clipper, the spacing between the anvil roll, blade and backup roll becomes critical. In practice it is suspected that precise adjustments would have to be provided between these three elements for effective operation.

Previously proposed rotary clippers are also limited in their attainable clipping speeds by the nature of their driving mechanisms. The clipper drive is coupled to the drives for the sheet conveyor and the anvil and bracing rolls so that clipper speed is synchronized with, and limited by, sheet and roll speeds.

Previously proposed rotary clippers as described also propose to use clutch and brake means to start and stop knife movement. This can lead to inaccuracy in indexing of the clipper blades for making the next cut after each cutting stroke. Inaccurate indexing in turn leads to inaccurate timing and thus inaccurate clipping, the effects of which are amplified at high sheet speeds.

Although not a veneer clipper, a device known as a rotary sheet breaker has been used to break a traveling ribbon of veneer into sheets of convenient length for further processing as it is peeled from the log. Such a breaker is characterized by a single shaft-mounted breaker knife which when activated by a manual control rotates through 360° into cutting cooperation with a roller anvil to break the sheet and return to its starting position. A drive mechanism including a clutch and brake is used to start and stop rotation of the breaker knife. Because of its 360° cutting cycle and the inherent limitations in speed and accuracy of the clutch and brake drive, such a sheet breaker is unsuitable for use as a veneer clipper.

Other rotary shearing or clipping devices have been suggested but they are not suitable for veneer clipping. For example, U.S. Pat. No. 3,111,875 discloses a rotary cutting device for cutting fibers which rotates continuously during operation and is therefore unsuitable for use as a veneer clipper.

The apparatus of U.S. Pat. No. 3,677,120 is representative of fluid cylinder-driven rotary shears using an interacting pair of rotary knives and developing high cutting forces for cutting slowly moving thick steel sheet material. The drive cylinder is capable of operating the shear only during its extension stroke. Such rotary shears, because of their slow operating speeds, slow sheet speeds and dual knife construction, are unsuited for use as veneer clippers.

From the foregoing it will be apparent that there is a need for a high-speed veneer clipper capable of accurate, close-interval clipping of defects from sheets of veneer traveling at high speed while minimizing the aforementioned problems of bunching, jamming and sheet breakage common with existing veneer clippers.

SUMMARY OF THE INVENTION

The present invention is a rotary veneer clipper with a unique fluid-mechanical drive enabling fast, accurate, close-interval clipping of veneer sheets traveling at considerably higher speeds than is now possible, hopefully in the range of from 600 to 1000 feet per minute.

The rotary clipper of the invention is characterized by a rotatable clipper shaft mounting one, two or more cutting blades at equally spaced positions about the shaft, the number depending on the closeness of the clipping interval desired and the inherent limitations of blade spacing dictated by edge curl and material thickness.

The clipper shaft is rotated intermittently on signal through a predetermined arc, depending on the number of cutting blades, sufficient to move a single cutting blade in cutting cooperation across a rotating roller anvil, with both the anvil and blade moving in the same direction as a sheet moving therebetween.

The clipper shaft is rotated through the necessary arc by a pair of fluid-powered drive cylinders which stroke simultaneously upon each clip signal. The drive cylinders transmit power to the clipper shaft through one of two separate power-transmitting paths depending on their directional mode of stroking so that the shaft is rotated through the necessary arc and in the same direction upon each stroking of the cylinders. Each power path includes a separate one-way clutch which operates to transmit power through its path to the clipper shaft only when such path is operable to rotate the shaft in the desired direction, which is during every other stroking of the cylinders.

A locking means including a third, locking cylinder stroked simultaneously with the drive cylinders and connected to the clipper shaft through a single crank arm, strokes the crank arm between two dead-center positions to limit shaft rotation to the precise arc desired. The locking cylinder also assists the drive cylinders in rotating the clipper shaft.

Optionally, the speed of rotation of the tips of the cutting blades can be synchronized with the surface speed of the roller anvil through the use of a third one-way clutch on the clipper shaft coupled to a selectively operable air clutch mechanically interconnecting the roller anvil drive and the clipper shaft.

A principal object of the present invention is to provide a rotary clipper capable of fast, accurate, close-interval clipping of thin sheet material such as wood veneer while the sheet travels at substantially higher speeds than is now possible with existing clippers.

Another principal object of the invention is to provide a rotary clipper as aforesaid capable of clipping a fast-moving sheet of material at closer intervals than is possible with existing clippers.

Another object is to provide a rotary clipper as aforesaid capable of clipping a fast-traveling sheet of wood veneer without the sheet-jamming, bunching and breakage problems of existing veneer clippers.

Another primary object of the invention is to provide an improved fluid-mechanical drive for a rotary clipper or shear enabling faster, more accurate and closer-interval clipping than is possible with existing rotary drive mechanisms.

Another object, making possible faster clipping speeds and therefore closer interval clipping, is to provide a drive mechanism for driving a rotary clipper knife at a speed unlimited by the sheet speed or the rotational speed of the roller anvil.

Yet another important object of the invention is to provide a rotary clipper as aforesaid having a positive blade-indexing feature which precisely positions a cutting blade for the next clip after each clipping stroke, thereby providing highly accurate timing of each clipping stroke.

A further important object is to provide a rotary clipper as aforesaid which is durable and capable of withstanding long periods of use without maintenance or adjustment.

Another object is to provide a rotary clipping device which is adaptable for clipping sheet materials of different thicknesses traveling at widely varying speeds into regular or random lengths as desired.

Still another object is to provide a rotary clipper as aforesaid having an optional speed control feature making it possible to synchronize the rotational speed of the knife blade with the speed of the roller anvil and sheet material.

The foregoing and other objects, features and advantages of the invention will become more apparent from the following detailed description which proceeds with reference to the accompanying drawing.

DETAILED DESCRIPTION

General Arrangement

Figure 1:
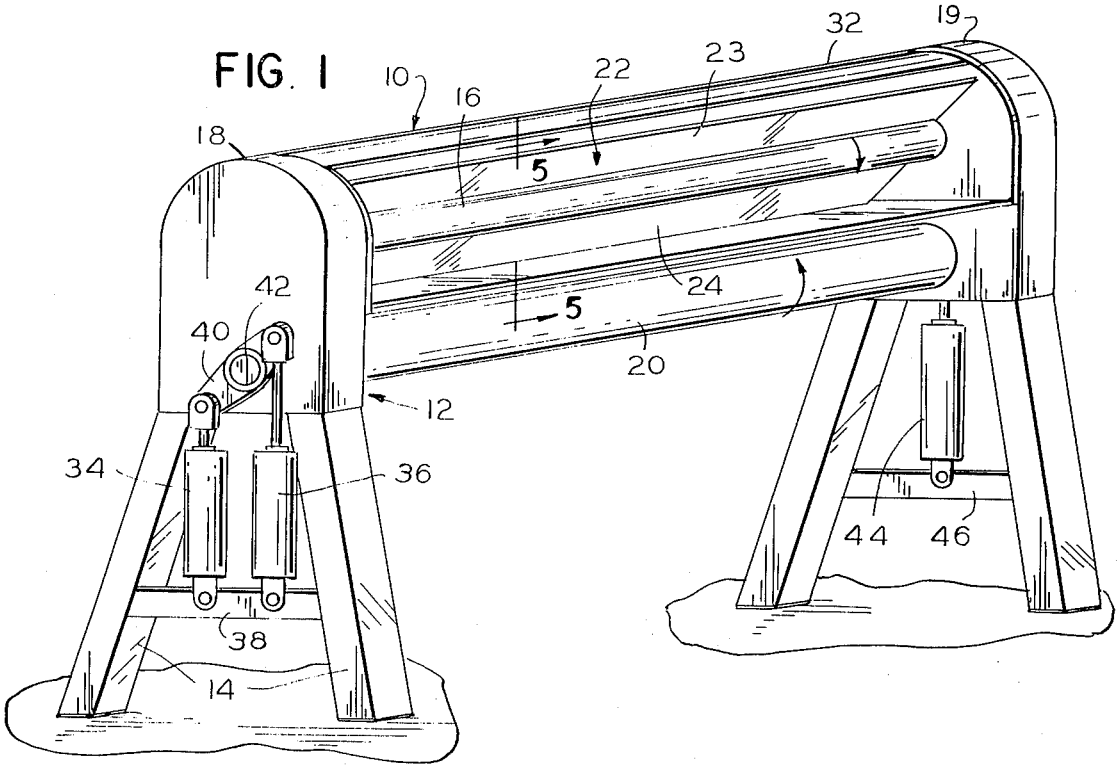
FIG. 1 is a frontal perspective view of a rotary veneer clipper in accordance with the invention.

Referring first to FIG. 1 of the drawings, a rotary veneer clipper 10 includes a support frame 12 including frame legs 14 supporting the working portion of the clipper above a floor support surface at the approximate level of a conveyor for a traveling sheet of veneer downstream of a veneer lathe and a defect-detecting scanner unit (not shown). Such a conveyor and scanning unit are illustrated in their conventional relationship to a veneer clipper in, for example, prior U.S. Pat. No. 3,808,925.

Figure 5:
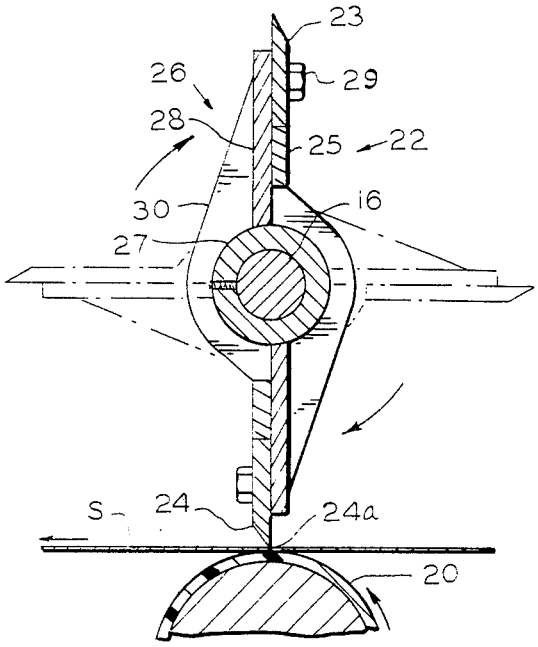
FIG. 5 is an enlarged cross-sectional view taken along the line 5—5 of FIG. 1 but with the clipper blades rotated to vertical positions.

The working elements of the clipper include a rotary clipper shaft 16 suitably journaled in bearings (not shown) within opposite end housings 18, 19 at the opposite ends of the machine. Housings 18, 19 cover drive and locking means for the clipper shaft for safety and appearance. A roller anvil 20 with a resilient surface is similarly journaled at opposite ends of the machine so as to extend parallel to and vertically below clipper shaft 16. A sheet of veneer S traveling on a conveyor downstream from the veneer lathe passes over the upper surface of anvil roll 20 below clipper shaft 16 as shown in FIG. 5. As a ribbon of veneer is peeled from the lathe and conveyed downstream through the clipper, anvil roll 20 is continuously driven in a counterclockwise direction as viewed in FIGS. 1 and 5 so that the upper surface of the roll travels in the same direction as the veneer sheet. Drive means for the anvil roll is not shown but is conventional, typically being a chain-and-sprocket drive from the sheet conveyor drive shaft so that the anvil roll is driven in timed relation to the speed of the sheet conveyor. One such anvil roll drive means is shown in the aforementioned U.S. Pat. No. 3,808,925.

Clipper shaft 16 carries a clipper knife 22 including a pair of knife blades 23, 24 which project radially from the shaft at 180° spaced-apart positions. Details of the clipper knife assembly are shown in FIG. 5. Shaft 16 is rotated clockwise intermittently through 180° by drive means in response to a clip signal to rotate blades 23, 24 180° from their horizontal at-rest positions shown in phantom in FIG. 5. During each rotation of shaft 16, one of blades 23, 24 passes through a vertically downward cutting position as occupied by blade 24 in FIG. 5, moving in the same direction as veneer sheet S. The lower cutting edge 24*a* of blade 24 passes through sheet S in cutting cooperation with the resilient uppermost surface of anvil roll 20 which is also traveling in the same direction as sheet S.

Each blade 23, 24 forms part of knife assembly 26 affixed to shaft 16. Such assembly includes a sleeve portion 27 keyed or otherwise fixed to shaft 16 and having backing flanges 28 to which each blade is fastened by threaded fasteners 29. Each blade is also supported at the edge opposite its cutting edge by a spacer member 25 between the blade and shoulders of gusset portions 30 on each backing member 28.

The top and sides of the rotary clipper shaft and knife assembly are shielded by a cage member 32 extending between the two end housings 18, 19.

Drive Mechanism

Figure 2:
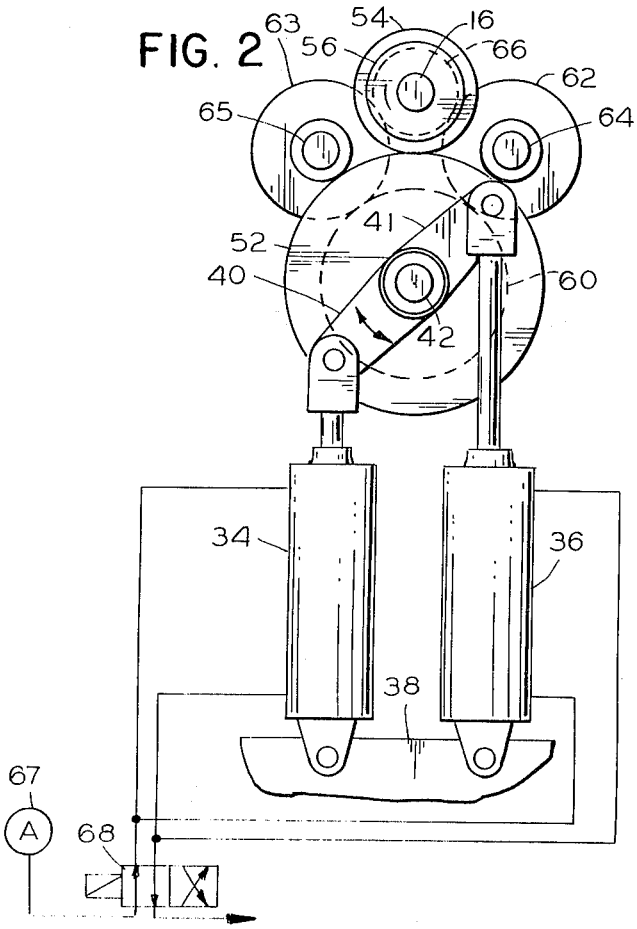
FIG. 2 is a view of the drive mechanism for the clipper in FIG. 1 as viewed looking toward the left end of the clipper of FIG. 1 with the end cover for the drive mechanism removed.
Figure 3:
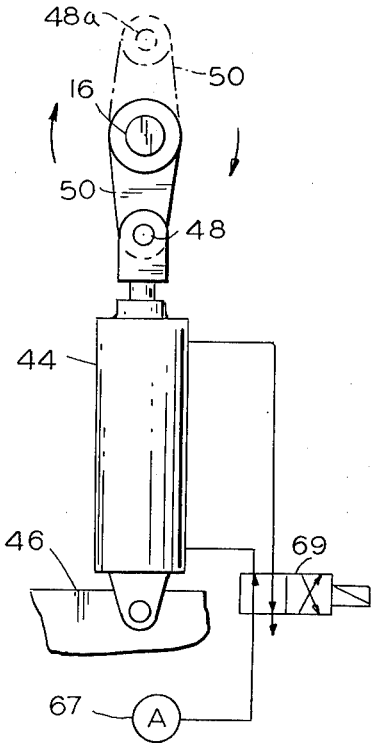
FIG. 3 is a view of the locking portion of the drive mechanism as viewed toward the right-hand end of the machine of FIG. 1 with the right end cover removed.

Major portions of the drive and locking mechanisms for the rotary clipper shaft and knife assembly are housed within the two end housings 18, 19, which have been removed in FIGS. 2, 3, 4 and 6 of the drawings showing such mechanisms. However, the prime movers for the clipper shaft are shown in the general view of FIG. 1 and include a pair of pneumatic, double-acting drive cylinders 34, 36 pivoted at their cap ends to a common cross frame member 38 and pivoted at their rod ends to the outer ends of crank members 40, 41, respectively. The crank members are fixed to opposite sides of a drive shaft 42 extending inwardly of end housing 18 so that successive strokes of the two cylinders will oscillate the drive shaft through 90°. At the opposite end of the machine, a single pneumatic, locking cylinder 44 is pivoted at its cap end to a cross frame member 46 and, as shown in FIG. 3, is pivoted at its rod end by a crank pin 48 to the outer end of a single crank arm 50 fixed to the opposite end of clipper shaft 16.

Now referring to FIG. 2, the primary drive mechanism includes, in addition to the pair of pneumatic drive cylinders 34, 36, first and second power-transmitting means drivingly connecting the drive cylinders to the clipper shaft.

Figure 4:
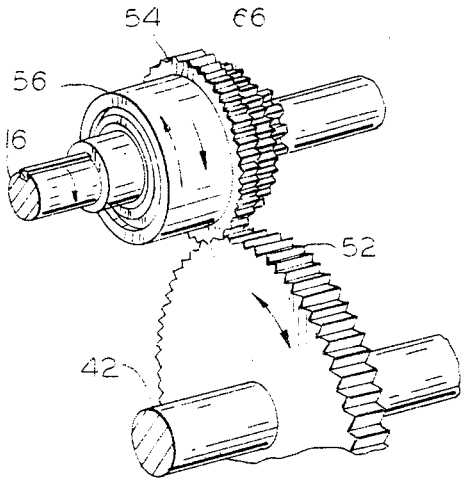
FIG. 4 is a perspective view of a portion of the drive mechanism of FIG. 2.

The first power-transmitting means comprises a first gear train including a first gear 52 on drive shaft 42 meshing with a second gear 54 on clipper shaft 16 and drivingly connected to the clipper shaft through a one-way clutch 56, shown best in FIG. 4, such as a Formsprag overrunning clutch as manufactured by the Formsprag Company.

The second power-transmitting means comprises a second gear train including a first gear 60 affixed to drive shaft 42 meshing with idler gears 62, 63 on idler shafts 64, 65 respectively. The idler gears mesh in turn with gear 66 on clipper shaft 16 which is drivingly connected to the clipper shaft through a second one-way clutch (not shown) similar to the first such clutch. Both one-way clutches are mounted on shaft 16 so as to drivingly engage such shaft only when their respective gear trains drive them in a clockwise direction, overrunning on such shaft when driven counterclockwise as viewed in FIGS. 1, 2 and 3.

Drive means for stroking pneumatic drive cylinders 34, 36 includes a conventional source of pressurized air 67 and control means 68 operable so that as one of such cylinders is extended under pressure, the other cylinder is simultaneously retracted under pressure to rotate drive shaft 42 through an arc of 90° in one direction or the other. Gear 52 of the first power train has twice the number of teeth of gear 54 so that upon each stroking of the two drive cylinders 34, 36, gear 54 is caused to rotate through 180°. Similarly in the second power train, gear 60 has twice the number of teeth of gear 66 so that upon each stroking of the drive cylinders the gear 66 is caused to rotate through 180° in a direction opposite the direction of rotation of gear 54. However, the two power trains do not act on clipper shaft 16 at the same time because of the overrunning of the clutch in one power train while the clutch in the other power train engages the clipper shaft.

The pneumatic lock cylinder 44 shown in FIG. 3 may be connected to the same pneumatic power source 67 as the drive cylinders 34, 36 and is controlled so as to extend or retract upon each stroking of the drive cylinders 34, 36. When locking cylinder 44 is in its retracted position as shown in FIG. 3, crank pin 48 is in its bottom dead-center position with respect to clipper shaft 16. When locking cylinder 44 is in its fully extended position, crank pin 48 is in its top dead-center position 48*a* with respect to clipper shaft 16 as shown in phantom in FIG. 3. The function of the locking cylinder assembly in driving and locking the clipper shaft will become apparent in the following description of the operation of the clipper.

Operation

In the operation of the clipper, blades 23, 24 of the knife assembly when at rest extend horizontally, one extending to the right in FIG. 5 ready for the next clip signal and the other to the left, having just completed a clip. At the same time, one drive cylinder is fully extended and the other fully retracted as shown in FIG. 2. Also at the same time crank pin 48 of the locking assembly is in one of its two dead-center positions shown in FIG. 3.

Upon receipt of a clip signal, the control means for the clip cylinders is operated. Such means could be one of several well-known control means familiar to persons skilled in the art, such as a solenoid-actuated two-position directional control valve 68 in the pneumatic circuit between drive cylinders 34, 36 and air source 67 and another similar valve 69 in the air circuit between locking cylinder 44 and the air source. The drive cylinder valve 68 would be positioned to extend cylinder 34 and simultaneously retract cylinder 36, rotating crank arms 40, 41 and thus drive shaft 42 and gear 52 clockwise 90°. Clockwise rotation of gear 52 causes meshing gear 54 on clipper shaft 16 to rotate counterclockwise 180°. However, since the overrunning one-way clutch 56 associated with gear 54 is rotated in its overrunning direction, counterclockwise rotation of gear 54 would not rotate clipper shaft 16 counterclockwise.

At the same time, however, gear 60 on drive shaft 42 is rotated clockwise 90°, causing idler gears 62, 63 to rotate counterclockwise, in turn rotating meshing gear 66 clockwise 180°. Clockwise rotation of gear 66 is in a direction to cause its associated one-way clutch to drivingly engage clipper shaft 16, causing the clipper shaft and thus its connected clipper blades to rotate clockwise through 180°. Thus with reference to FIG. 5, assuming that blade 23 is in a horizontal ready-to-clip position to the right of shaft 16, it is rotated clockwise across the counterrotating roller anvil 20 and through traveling sheet S, severing the sheet and continuing to rotate to a horizontal position to the left of clipper shaft 16. At the same time opposed blade 24 moves through 180° to the ready-to-clip position to the right of clipper shaft 16.

As a clip signal causes the stroking of the drive cylinders as described, the same signal activates the control valve for lock cylinder 44, admitting pressurized air to the cap end of such cylinder to tend to extend it. However, since crank pin 48 is in its bottom dead-center position, it cannot rotate off dead-center until the drive cylinders at the opposite end of the clipper shaft 16 start to rotate the shaft clockwise. As soon as shaft 16 rotates crank pin 48 off dead-center, cylinder 44 extends under power to aid the drive cylinders in rotating the clipper shaft until crank pin 48 reaches its top dead-center position 48*a*. At this point further clockwise rotation of crank pin 48*a* is prevented and thus clipper shaft 16 is locked against further clockwise rotation. Any tendency of clipper shaft 16 to counterrotate is also prevented by the clutch associated with gear 66. Thus clipper shaft 16 is effectively locked against further rotation in either direction after exactly 180° or clockwise rotation upon each stroking of the drive and locking cylinders despite the inertia forces generated by rapid rotation of the knife assembly about the axis of the clipper shaft. As a result, blades 23, 24 are precisely indexed after each stroking of the cylinders.

When the next clip signal is received, the pressurized air to the drive and locking cylinders is reversed, being supplied to the rod end of drive cylinder 34, the cap end of cylinder 36, and the rod end of locking cylinder 44. This causes 90° counterclockwise rotation of the crank arms 40, 41, drive shaft 42 and gear 52. Gear 52 rotates connecting gear 54 on clipper shaft 16 clockwise 180°. Since the one-way clutch associated with gear 54 is drivingly engaged to the clipper shaft upon clockwise rotation, the clipper shaft and its clipper blades are also rotated 180° clockwise, thereby moving clipper blade 24 180° through a clipping stroke.

At the same time, counterclockwise rotation of drive shaft 42 rotates its connected gear 60 90° counterclockwise, causing idler gears 62, 63 to rotate clockwise and gear 66 on the clipper shaft to rotate 180° counterclockwise. However, the overrunning clutch associated with gear 66 does not engage the clipper shaft upon counterclockwise rotation and therefore there is no tendency to rotate the clipper shaft counterclockwise.

As the drive cylinders start to rotate the clipper shaft clockwise, crank pin 48 of the locking assembly, now in its top dead-center position, is rotated clockwise from such position, enabling retraction of locking cylinder 44 under power to help rotate the clipper shaft. This continues until the crank pin reaches its bottom dead-center position, whereupon further rotation of the clipper shaft stops, locking the shaft and indexing the clipper blades in horizontal positions ready for the next clip signal.

From the foregoing it will be apparent that both drive cylinders 34, 36 and locking cylinder 44 provide power for rotating the clipper shaft during each clipping stroke. More importantly, the described pneumatic-mechanical drive rotates the clipper shaft to clip material upon each stroke of the drive and locking cylinders, thereby enabling high-speed close interval clipping while a sheet S travels at high lineaar speeds.

Optional Speed Synchronization

Figure 6:
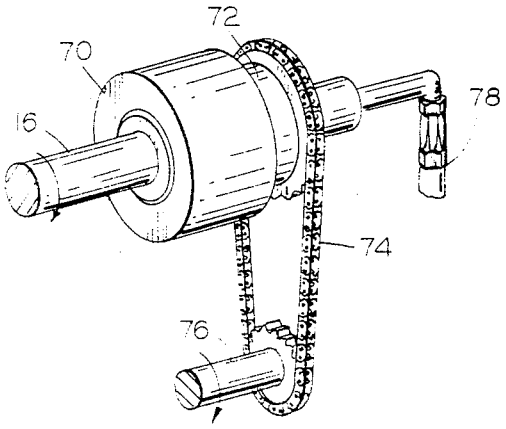
FIG. 6 is a perspective view of the right-hand end of the clipper shaft of FIG. 1 within the right end cover in an optional modification of the drive mechanism.

FIG. 6 illustrates an optional means for synchronizing the rotational speed of the outer cutting edges of the knife blades with the surface speed of the roller anvil. The synchronizing means includes a third one-way clutch 70 on clipper shaft 16 at the same end of the shaft as the locking cylinder. Such one-way clutch drives the center element of an air-operated clutch 72 such as a Fawick air clutch. The outer element of the air clutch is connected by a sprocket and roller chain drive 74 to a drive shaft 76 of the sheet conveyor (not shown). Typically the roller anvil would also be driven from the sheet conveyor drive shaft whereby adjustment of the drive ratios between the roller anvil drive shaft and the clipper shaft produces the desired speed synchronization. Air passage means 78 from the air pressure source is connected to the air clutch. When the air clutch is disengaged due to the absence of air pressure at passage 78, roller chain drive 74 will simply free-wheel with respect to clipper shaft 16. However, when air pressure is admitted to the air clutch through passage 78, the outer and center elements of the air clutch become engaged and the center element, being driven by one-way clutch 70, back drives clutch 70 to control its speed of rotation. Since clutch 70 drivingly engages shaft 16 whenever shaft 16 is rotated by its drive cylinders, the back driving or braking effect of the air clutch is transmitted through clutch 70 to the clipper shaft to control the rotational speed of clipper blades 23, 24.

Although the illustrated rotary clipper embodies two clipper blades, it should be understood that the rotary clipper may be designed with any number of blades desired including one, three or more within limits dictated by the thickness of the material to be clipped and the tendency of the clipped material ends to curl. The number of blades required will depend on the speed of travel of the sheet and the closeness of the clipping interval required. For most veneer clipping applications two blades should be adequate.

To illustrate the increased material speeds possible with a multiple blade clipper, a one-blade clipper would require that its blade move through a full 360° upon each clipping stroke rather than through 180° as in the two-blade clipper. Also a gear train would be provided at the locking cylinder end of the machine between the single crank arm 50 and the clipper shaft to provide for 360° rotation of the clipper shaft upon each 180° of rotation of the crank pin 48 between its two dead-center positions.

In a three-blade clipper three blades would radiate from the clipper shaft at 120° spaced-apart positions. The power trains between the drive cylinders and the clipper shaft would be geared to provide only 120° rotation of the shaft rather than 180° rotation as in the two-blade clipper. Thus with a three-blade clipper, closer clipping intervals are theoretically possible than with a two or one blade clipper, assuming the same sheet speed. Alternatively, faster sheet speeds are possible with the three-blade clipper if closer clipping intervals are not required. With a three-blade clipper a gear train would be provided between locking cylinder crank arm 50 and the clipper shaft to provide exactly 120° rotation of the clipper shaft upon each 180° movement of the crank arm between its two dead-center positions.

In a four-blade clipper the blades would radiate from the clipper shaft at 90° spaced-apart positions, requiring 90° of rotation upon each stroking of the drive cylinders. Thus it would be possible to provide a direct connection between the crank members 40, 41 of FIG. 2 and the one-way clutches on the clipper shaft or even direct offset connections of the drive cylinders to different one-way clutches on the clipper shaft to achieve the desired one-way intermittent rotation without any intervening drive shafts or gear trains. With such a modified power transmission means, however, only one of the two drive cylinders would transmit power to the clipper shaft during each stroking of the drive cylinders. With a four-blade clipper, a gear train would still be provided between crank arm 50 of locking cylinder 44 and the clipper shaft to provide only 90° of rotation of the clipper shaft upon each 180° rotation of crank arm 50.

Four blades on a single clipper shaft is probably about the maximum number of blades that should be used as a practical matter in clipping most sheet materials because of the inadequate clearance that would result between the tip of a blade in the ready-to-clip position and the traveling sheet if a larger number of blades are used.

Although in the illustrated embodiment of FIG. 2 the two drive cylinders 34, 36 are caused to stroke simultaneously in opposite directions, the two cylinders and their respective power-transmitting means can be rearranged so that the two cylinders stroke simultaneously in the same direction. For example, this may be done simply by positioning both drive cylinders and their respective crank arms on the same side of drive shaft 42. However, regardless of whether the drive cylinders are arranged to stroke simultaneously in the same or opposite directions, in either case power is transmitted by one or both of the drive cylinders to the clipper shaft through one of the two power-transmitting means during simultaneous stroking of the cylinders in one directional mode and through the other of the two power-transmitting means during simultaneous stroking of such cylinders in their opposite directional mode.

Although the described fluid-mechanical drive is especially suitable for use in rotary clippers, it is adaptable to any power-transmitting application requiring an intermittent rotary drive, and particularly one requiring accurate indexing of the shaft position after each rotation.

Having illustrated what is presently a preferred embodiment of my invention and having also suggested several alternative embodiments, it should be apparent to those skilled in the art that the rotary clipper and drive of my invention are capable of modification in arrangement and detail. I claim as my invention all such modifications and equivalents as come within the true spirit and scope of the following claims.

I claim:

1. A fluid-mechanical drive for a rotary device comprising:

a driven shaft mounted for rotation about its axis, a first fluid-operated drive cylinder means, a second fluid-operated drive cylinder means, means for stroking said first and second cylinder means simultaneously, first power-transmitting means including a first one-way clutch means connecting at least said first cylinder means through a first crank means to said driven shaft for rotating said shaft in a given direction upon stroking said first cylinder means in one of its two stroking directions, and second power-transmitting means including a second one-way clutch means connecting at least said second cylinder means through a second crank means to said driven shaft for rotating said shaft in said given direction upon stroking of said second cylinder means in one of its two stroking directions as said first cylinder strokes in the other of its two stroking directions whereby upon each simultaneous stroking of said first and second cylinder means said shaft is caused to rotate in said given direction.

2. Apparatus according to claim 1 wherein said device is a rotary clipper and said driven shaft is a clipper shaft having at least one clipper blade.

3. Apparatus according to claim 2 wherein said clipper shaft mounts at least one said cutting blade extending generally axially along said shaft, each said stroking of said first and second cylinder means being operable to rotate one said cutting blade through a predetermined arc in cutting cooperation with another cutting element of said clipper.

4. Apparatus according to claim 3 including locking means operable to prevent rotational movement of said shaft beyond said predetermined arc and thereby index said blade for the next cutting stroke after each operation of said cylinder means.

5. Apparatus according to claim 4 wherein said locking means comprises a third fluid-powered locking cylinder means and third power-transmitting means including a third crank means mechanically connecting said third cylinder means to said shaft during both extension and retraction of said third cylinder means, said third cylinder means being operable to rotate said crank means between first and second dead-center positions upon each stroking movement of said third cylinder means, and means operable to stroke said third cylinder means upon each stroking movement of said first and second cylinder means so that upon stroking of said first, said second and said third cylinder means: (1) one of said first and second power-transmitting means commences rotation of said clipper shaft in said given direction and thereby rotates said third crank means from a first dead-center position; (2) said third cylinder means transmits power through said third crank means to assist said first and second cylinder means in rotating said clipper shaft in said given direction; (3) said third cylinder means rotates said third crank means to a second dead-center position to lock said clipper shaft against further rotation in said given direction; and (4) one of said first and second clutch means prevents counterrotation of said clipper shaft whereby said clipper shaft remains locked against rotational movement until the next stroking movement of said first and second cylinder means.

6. Apparatus according to claim 2 wherein said clipper shaft has at least two cutting blades extending generally axially along said shaft and generally radially from said shaft at equally spaced-apart positions about said shaft, a roller anvil extending parallel to said clipper shaft and rotatable in a direction opposite the direction of rotation of said clipper shaft, said roller anvil being spaced from said clipper shaft such that said cutting blades pass in cutting cooperation with the peripheral surface of said roller anvil, each said stroking of said first and second cylinder means being operable to rotate one of said cutting blades from a starting position spaced from said peripheral surface into cutting relationship with said surface and to an ending position spaced from said surface.

7. Apparatus according to claim 6 wherein said shaft has two blades and said first and second power-transmitting means are operable to rotate said clipper shaft through an arc of 180° during each stroking of said first and second cylinder means.

8. Apparatus according to claim 2 wherein said clipper includes said clipper shaft mounting at least one cutting blade extending along said shaft, a roller anvil extending parallel to said clipper shaft for cutting cooperation with said cutting blade, anvil drive means for rotating said roller anvil in a direction opposite the direction of rotation of said clipper shaft, and means for synchronizing the rotational speed of said cutting blade with the rotational speed of said roller anvil.

9. Apparatus according to claim 8 wherein said means for synchronizing the rotational speed of said cutting blade with the rotational speed of said roller anvil comprises a third one-way clutch means on said clipper shaft engageable with said shaft upon rotation of said shaft in said given direction, air-operated clutch means drivingly engaged by said one-way clutch means and mechanical speed control means interconnecting said air-operated clutch means and said anvil drive means such that whenever said first and second cylinder means rotate said clipper shaft in said given direction and air under operating pressure is applied to said air-operated clutch means, the speed of rotation of said clipper shaft is governed by the speed of said roller anvil.

10. Apparatus according to claim 2 wherein said first and second power-transmitting means include a common drive shaft, said first and second crank means being connected to said drive shaft and to said first and second cylinder means for oscillating said drive shaft about its axis upon successive strokings of said cylinder means, said first power-transmitting means further including a first gear train for transmitting power from said drive shaft to said clipper shaft, said second power-transmitting means further including a second gear train independent of said first gear train for transmitting power from said drive shaft to said clipper shaft, said first one-way clutch means being interposed between said first gear train and said clipper shaft so as to transmit power to said clipper shaft only when said drive shaft is oscillated in one direction, said second one-way clutch means being interposed between said second gear train and said clipper shaft so as to transmit power to said clipper shaft only when said drive shaft is oscillated in a direction opposite said one direction.

11. Apparatus according to claim 1 including locking means operable upon each stroking movement of said first and second cylinder means to lock said shaft against further rotation after each rotation thereof through a predetermined arc.

12. Apparatus according to claim 1 including locking means operable upon each stroking movement of said first and second cylinder means to lock said shaft against rotation beyond a predetermined arc, said locking means including a third double-acting fluid-operated power cylinder means mechanically connected to said shaft through a third power-transmitting means including a third crank means upon both extension and retraction of said third cylinder means, said third crank means being movable between two dead-center positions upon each stroking movement of said third cylinder means to lock said shaft against continued rotation, and means for stroking said third cylinder means simultaneously with the stroking of said first and second cylinder means.

13. A rotary clipper comprising:

a rotatable clipper shaft mounting at least one clipper blade, a rotatable roller anvil parallel to said clipper shaft and spaced therefrom for cutting cooperation with said clipper blade, fluid-mechanical drive means for rotating said clipper shaft intermittently through a predetermined arc to pass said clipper blade across said roller anvil, said fluid-mechanical drive means comprising first and second drive cylinder means operable to stroke once simultaneously in response to a clip signal, first and second independent power-transmitting means each including one-way clutch means drivingly connecting said first and second drive cylinder means to said clipper shaft in a manner such that said first and second power-transmitting means alternate in transmitting power to said shaft upon each successive stroking of said first and second cylinder means, said first power-transmitting means being operable to rotate said clipper shaft through its said one-way clutch through said predetermined arc in one direction of rotation during simultaneous stroking of said first and second cylinder means in one directional mode, and said second power-transmitting means being operable to rotate said clipper shaft through its said one-way clutch through said predetermined arc in said one direction of rotation during simultaneous stroking of said first and second cylinder means in a directional mode opposite said one directional mode such that said clipper shaft rotates through said predetermined arc in said one direction of rotation upon each simultaneous stroking of said first and second drive cylinder means.

14. A rotary clipper according to claim 13 including a locking means for limiting rotation of said clipper shaft to said predetermined arc upon each stroking of said drive cylinder means, said locking means including a locking cylinder means drivingly connected to said clipper shaft through a crank arm means, said crank arm means being rotatable between two dead-center positions upon each stroking of said locking cylinder means, said locking cylinder means being operable to stroke once upon each stroking movement of said first and second drive cylinder means.

15. A clipper according to claim 13 wherein said first and second cylinder means stroke simultaneously in opposite directions such that one cylinder means extends as the other cylinder means retracts.

* * * * *